US010246779B2

(12) United States Patent
Miyai et al.

(10) Patent No.: US 10,246,779 B2
(45) Date of Patent: Apr. 2, 2019

(54) SURFACE-TREATED ALUMINUM PLATE, ORGANIC-RESIN-COATED SURFACE-TREATED ALUMINUM PLATE, CAN BODY AND CAN LID FORMED BY USING THE SAME

(71) Applicant: TOYO SEIKAN GROUP HOLDINGS, LTD., Tokyo (JP)

(72) Inventors: Tomohiro Miyai, Kanagawa (JP); Takuya Kashiwakura, Kanagawa (JP); Yuji Funagi, Kanagawa (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 15/904,860

(22) Filed: Feb. 26, 2018

(65) Prior Publication Data

US 2018/0179635 A1 Jun. 28, 2018

Related U.S. Application Data

(62) Division of application No. 14/387,714, filed as application No. PCT/JP2013/059502 on Mar. 29, 2013, now abandoned.

(30) Foreign Application Priority Data

Mar. 30, 2012 (JP) ..... 2012-082181
Mar. 30, 2012 (JP) ..... 2012-082182
Mar. 26, 2013 (JP) ..... 2013-064171

(51) Int. Cl.
*C23C 22/34* (2006.01)
*B65D 25/14* (2006.01)
*B65D 25/34* (2006.01)

(52) U.S. Cl.
CPC ..... *C23C 22/34* (2013.01); *B65D 25/14* (2013.01); *B65D 25/34* (2013.01);
(Continued)

(58) Field of Classification Search
CPC ..... C23C 22/34; B65D 25/34; B65D 25/14; Y10T 428/25; Y10T 428/1355; Y10T 428/31681
See application file for complete search history.

(56) References Cited

U.S. PATENT DOCUMENTS 4,148,670 A 4/1979 Kelly
7,749,582 B2 7/2010 Kurokawa et al.
(Continued)

FOREIGN PATENT DOCUMENTS

EP 1241236 9/2002
JP 52-131937 11/1977
(Continued)

OTHER PUBLICATIONS

Japanese Office Action issued in Counterpart Patent Application No. 2013-064171, dated Oct. 18, 2016.
(Continued)

*Primary Examiner* — Michael C Miggins
(74) *Attorney, Agent, or Firm* — Greenblum & Bernstein, P.L.C.

(57) ABSTRACT

A surface-treated aluminum plate obtained by forming, on at least one surface of an aluminum plate, a conversion-coated layer that contains a polyester resin and a zirconium compound or a titanium compound. The surface-treated aluminum plate excellently adheres to an organic resin coating and can be used as a material for producing cans featuring excellent corrosion resistance and shock resistance.

3 Claims, 1 Drawing Sheet

(52) U.S. Cl.
CPC ..... *Y10T 428/1355* (2015.01); *Y10T 428/25* (2015.01); *Y10T 428/31681* (2015.04)

(56) References Cited

U.S. PATENT DOCUMENTS

| | | | |
|---|---|---|---|
| 7,938,950 | B2 | 5/2011 | Kurokawa et al. |
| 2010/0215965 | A1 | 8/2010 | Tadaki et al. |
| 2010/0260953 | A1 | 10/2010 | Tadaki et al. |

FOREIGN PATENT DOCUMENTS

| | | | |
|---|---|---|---|
| JP | 11-156998 | | 6/1999 |
| JP | 11-229156 | | 8/1999 |
| JP | 2000-204485 | | 7/2000 |
| JP | 2001-303267 | | 10/2001 |
| JP | 2003-165177 | | 6/2003 |
| JP | 2005-97712 | | 4/2005 |
| JP | 2005-281863 | | 10/2005 |
| JP | 2006-336106 | | 12/2006 |
| JP | 2007-176072 | | 7/2007 |
| JP | 2008-069413 | | 3/2008 |
| JP | 2008-296439 | | 12/2008 |
| JP | 2008-297595 | A | 12/2008 |
| JP | 2009-079252 | | 4/2009 |
| JP | 2009-132952 | A | 6/2009 |
| WO | 02/20652 | | 3/2002 |
| WO | 2008/149787 | A1 | 12/2008 |

OTHER PUBLICATIONS

Extended Euopean Search Report issued in European Patent Application No. 13769525.0, dated Oct. 27, 2015.
Search report from International Bureau of WIPO in PCT/JP2013/059502, dated Apr. 23, 2013.
Japanese Office Action issued in Counterpart Patent Application No. 2017-115988, dated Feb. 20, 2018.

SURFACE-TREATED ALUMINUM PLATE, ORGANIC-RESIN-COATED SURFACE-TREATED ALUMINUM PLATE, CAN BODY AND CAN LID FORMED BY USING THE SAME

CROSS-REFERENCE TO RELATED APPLICATIONS

The present application is a continuation application of U.S. application Ser. No. 14/387,714, filed Sep. 24, 2014, which is a National Stage of International Patent Application No. PCT/JP2013/059502, filed Mar. 29, 2013, which claims priority of JP 2013-064171, filed Mar. 26, 2013, JP 2012-082182, filed on Mar. 30, 2012 and JP 2012-082181, filed Mar. 30, 2012. The entire disclosures of U.S. application Ser. No. 14/387,714 and International Application PCT/JP2013/059502 are expressly incorporated by reference herein.

TECHNICAL FIELD

This invention relates to a surface-treated aluminum plate and to an organic resin-coated surface-treated aluminum plate obtained by coating the above aluminum plate with an organic resin. More specifically, the invention relates to a surface-treated aluminum plate and to an organic resin-coated surface-treated aluminum plate featuring excellent adhesion to the organic resin coating, and exhibiting excellent corrosion resistance and close adhesion during the working when used as materials for producing cans.

BACKGROUND ART

The organic resin-coated metal plate obtained by coating a metal blank such as of aluminum with an organic resin has long been known as a material for producing cans. It has also been well known to put a laminate thereof to the draw working or the draw ironing working to produce seamless cans for containing beverage, or to put the laminate thereof to the press forming to produce can lids such as easy-open ends.

In the organic resin-coated metal plate, however, adhesion property is not enough between the aluminum plate and the organic resin coating, or the corrosion resistance of the aluminum plate is not enough. Therefore, it is a practice to treat the surface of the aluminum plate with an inorganic or organic surface-treating agent. For instance, there has been known a chromic phosphate type surface-treating material which in the form of a single layer exhibits excellent corrosion resistance as well as excellently adhesion property when various organic resins are applied thereon. Many of the chromate treatments now utilized are those of the type that do not leave hexavalent chromium in the final products. However, the treating solution contains hexavalent chromium which is a toxic substance. Besides, after the disposal, it is worried that chromium might elute out into the soil. Therefore, it has been urged to develop a chromium-free surface treatment.

Various kinds of chromium-free surface treatments have been proposed for the materials for producing cans. As the chromium-free surface treatments for the aluminum alloy type metal plates, there have been proposed a method of forming a conversion-coated layer comprising an zirconium oxide and/or titanium as a main component on the surface of the aluminum-containing metal material by using an acidic treating solution that contains zirconium, titanium or a compound thereof, phosphate and fluoride and that has a pH of about 1.0 to 4.0 (patent document 1), and a method of forming an organic-inorganic composite layer containing an organic compound of carbon as a main component, a phosphorus compound and a zirconium compound or a titanium compound (patent document 2). Further, the present applicant has also proposed a surface-treated metal material based on a chromium-free treatment using Zr, O and F as main components but without using phosphoric acid ions, the chromium-free treatment being applicable to aluminum plates, steel plates as well as to containers (patent document 3).

PRIOR ART DOCUMENTS

Patent Documents:
Patent document 1: JP-A-52-131937
Patent document 2: JP-A-11-229156
Patent document 3: JP-A-2005-97712

OUTLINE OF THE INVENTION

Problems that the Invention is to Solve

With the above conversion-coated layer, however, the corrosion resistance could not be obtained to a sufficient degree despite an organic resin coating was formed thereon as a pre-coating material to produce can bodies or can lids. With the method of forming the organic-inorganic composite layer containing an organic compound of carbon as a main component, a phosphorous compound and a zirconium compound or a titanium compound, the adhesion to the organic resin coating could be improved to some extent without, however, satisfying corrosion resistance or shock resistance (dent resistance). The surface-treated material that contains Zr, O and F as main components but contains no phosphoric acid ion, features excellent adhesiveness to the organic resin coating and excellent corrosion resistance, but has to be formed relying on an electrolytic treatment. Therefore, it has been desired to provide a surface-treated metal material that excellently adheres to the organic resin coating, that has excellent corrosion resistance, that is advantageous in economy and productivity, and that can be produced by the conversion treatment.

Further, when the organic resin-coated surface-treated aluminum plate is subjected to a severe working such as draw-ironing working to produce seamless cans, strain occurs in the organic resin coating due to the working producing a difference in the contraction of the resin relative to the surface-treating film and causing peeling between the organic resin coating and the surface-treated aluminum plate. That is, the organic resin-coated surface-treated aluminum plate is subjected to the draw-ironing working or to the draw-redraw working to produce can bodies which are, thereafter, subjected to a heat treatment to relax the strain in the organic resin coating. Here, however, if the conversion-coated layer is not closely adhered to the aluminum plate or if the conversion-coated layer itself does not have sufficient degree of strength, then it peels off the organic resin layer in the step of heat treatment, making it difficult to execute the necking or the flanging after the step of heat treatment.

It is, therefore, an object of the present invention to provide a surface-treated aluminum plate that excellently adheres to the organic resin coating and is capable of exhibiting excellent corrosion resistance and shock resistance (dent resistance) as a material for producing cans.

Another object of the present invention to provide a surface-treated aluminum plate that very excellently adheres to the organic resin coating to endure the step of heat treatment and the step of severe working such as flanging.

A further object of the present invention is to provide an organic resin-coated surface-treated aluminum plate obtained by coating the surface-treated aluminum plate with an organic resin, and a can body and a lid formed therefrom.

A still further object of the present invention is to provide a surface-treating solution capable of forming the surface-treated aluminum plate.

Means for Solving the Problems

According to the present invention, there is provided a surface-treated aluminum plate obtained by forming, on at least one surface of an aluminum plate, a conversion-coated layer that contains a polyester resin and a zirconium compound or a titanium compound.

In the surface-treated aluminum plate of the present invention, it is desired that:

1. The ratio C/M of the amount C of carbon and the amount M of zirconium or titanium in the conversion-coated layer lies in a range of 1 to 80;
2. The conversion-coated layer contains a polycarboxylic acid;
3. The conversion-coated layer contains a metal chelate complex that comprises aluminum ions, zirconium ions or titanium ions and a polycarboxylic acid;
4. The conversion-coated layer contains a particulate component;
5. The ratio C/M of the amount C of carbon and the amount M of zirconium or titanium is contained in a range of 1 to 40 in the conversion-coated layer that contains the polycarboxylic acid and/or the particulate component;
6. The particulate component comprises water-dispersible crosslinked particles of a copolymer of a methyl poly (meth)acrylate or a copolymer of a methyl poly(meth) acrylate and a poly(meth)acrylic acid, or comprises particles of an inorganic silica compound; and
7. The particulate component has a particle size in a range of 1 to 200 nm.

According to the present invention, further, there is provided an organic resin-coated surface-treated aluminum plate obtained by forming an organic resin coating on the conversion-coated layer film of the surface-treated aluminum plate.

According to the invention, further, there are provided a can body and a can lid formed from the organic resin-coated surface-treated aluminum plate.

According to the present invention, further, there is provided a surface-treating solution for treating the surface of an aluminum plate by a conversion treatment, the surface-treating solution containing a water-dispersible polyester resin and fluorine ions, zirconium ions or titanium ions.

In the surface-treating solution of the invention, it is desired that:

1. The polyester resin is contained in an amount of 100 to 10,000 ppm, and the zirconium ions or the titanium ions are contained in an amount of 5 to 5,000 ppm;
2. A polycarboxylic acid and/or a water-dispersible particulate component is contained; and
3. The polyester resin is contained in an amount of 500 to 10,000 ppm, the water-dispersible particulate component is contained in an amount of 100 to 3,000 ppm, the polycarboxylic acid is contained in an amount of 5 to 2,000 ppm, and the zirconium ions or the titanium ions are contained in an amount of 5 to 5,000 ppm.

Effects of the Invention

The surface-treated aluminum plate of the present invention has excellent corrosion resistance and adhesion property to the organic resin coating, and the resin-coated surface-treated aluminum plate obtained by coating the surface-treated aluminum plate with an organic resin exhibits excellent corrosion resistance and close adhesion during the working even when it is subjected to a severe working such as draw-ironing working, i.e., exhibits very distinguished corrosion resistance and closely adhesion during the working as compared to those of the metal plates treated with the chromic phosphate that have heretofore been used for producing cans. Therefore, the surface-treated aluminum plate of the invention can be favorably used as a material for producing can bodies and can lids.

Further, even if a polyester film is pre-coated as an organic resin coating, there is no need of interposing a coating such as primer between the conversion-coated layer and the polyester film, giving advantage in productivity and economy.

Further, with the polycarboxylic acid being contained in the conversion-coated layer, there are made present aluminum ions, zirconium ions or titanium ions and the polycarboxylic acid as a metal chelate complex which works to improve close adhesion between the metal and the organic material. Therefore, corrosion resistance and close adhesion during the working can be markedly improved being assisted by the improved adhesion property due to the polyester resin.

Further, the particulate component that is contained in the conversion-coated layer controls the fluidity of the conversion-coated layer. Besides, the anchoring effect of the particulate component helps greatly improve close adhesion to the organic resin coating. Therefore, even when subjected to a severe working such as draw-ironing working, the organic resin-coated surface-treated aluminum plate obtained by coating the surface-treated aluminum plate with the organic resin, maintains very good close adhesion to the organic resin coating, effectively preventing the organic resin coating from peeling off during the heat treatment, specifically, after the draw-ironing working, in the step of heat treatment in which severe working is executed and in the flange-forming portion, too.

By adding a water-dispersible polyester resin to the surface-treating solution that is used for the production of the surface-treated aluminum plate, it is allowed to make present the polyester resin together with the zirconium compound or the titanium compound in the conversion-coated layer and, therefore, to obtain excellent corrosion resistance and closely adhesion during the working.

By blending the surface-treating solution with the polycarboxylic acid, further, the polyester resin can be made present homogeneously together with the zirconium compound or the titanium compound in the surface-treating film. Besides, the polycarboxylic acid forms a metal chelate complex with zirconium ions or titanium ions attaining more excellent corrosion resistance and closely adhesion during the working.

By blending the surface-treating solution with the particulate component, further, the particulate component deposits simultaneously with the deposition of the zirconium compound or the titanium compound making it possible to control the fluidity of the conversion-coated layer as well as to further improve closely adhesion to the organic resin coating due to the anchoring effect of the particulate component.

MODES FOR CARRYING OUT THE INVENTION

Figure 1:
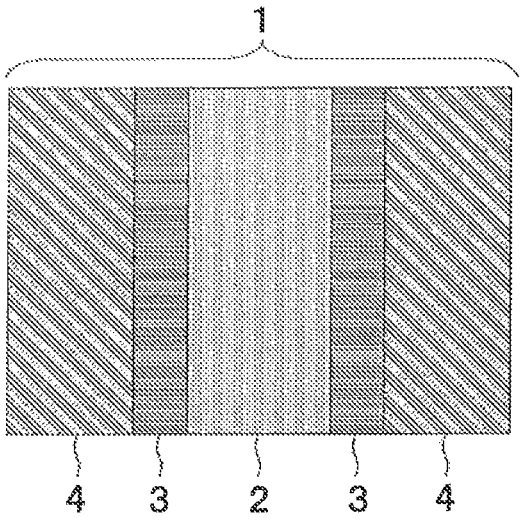
FIG. 1 is a view showing a structure in cross section of an organic resin-coated surface-treated aluminum plate of the present invention.

The surface-treated aluminum plate of the present invention has a conversion-coated layer that contains a polyester resin and a zirconium compound or a titanium compound and is formed on at least one surface of an aluminum plate.

There have heretofore been known inorganic conversion-coated layer s containing a zirconium compound or a titanium compound. However, the conversion-coated layer formed on the surface-treated aluminum plate of the present invention, further, contains, in addition to the inorganic substances, polyester resin and, a polycarboxylic acid providing more excellent corrosion resistance and close adhesion during the working than those of the conventional inorganic conversion-coated layers.

That is, the conversion-coated layer on the surface-treated aluminum plats of the invention has the zirconium compound or the titanium compound positioned on the side of the aluminum plate working to fix the polyester resin to the aluminum plate. Through the heat treatment at the time of applying the organic resin coating, the polyester resin uniformly covers the surface of the conversion-coated layer providing corrosion resistance and markedly improved adhesion property to the organic resin coating that will be applied next.

Further, the polycarboxylic acid that is contained forms a metal chelate complex with aluminum ions, zirconium ions or titanium ions. The metal chelate complex, too, works to improve closely adhesion between the metal and the organic material. Therefore, the corrosion resistance and the closely adhesion during the working can be further improved being compounded by the improved close adhesion due to the polyester resin.

According to the present invention, further, at the time of forming the conversion-coated layer, the zirconium compound or the titanium compound is deposited and, at the same time, the polyester resin and the particulate component are deposited. This makes it possible to improve closely adhesion between the aluminum plate and the organic resin coating due to the anchoring effect and, further, to control the fluidity of the conversion-coated layer owing to the particulate component, preventing the organic resin coating from peeling off during the heat treatment after the working and improving the dent resistance as well.

The above excellent effects of the invention will also become obvious from the results of Examples appearing later.

Namely, when no polyester resin is contained in the conversion-coated layer, the corrosion resistance is not satisfactory (Comparative Example 1). Further, when a film comprising the polyester resin only without containing zirconium or titanium compound is formed on the aluminum plate by an application method, the adhesion during the working is not satisfactory (Comparative Example 2). On the other hand, the surface-treated aluminum plate of the present invention yields satisfactory results in both corrosion resistance and closely adhesion during the working (Examples 1 to 11).

Further, when the surface-treating solution contains neither the water-dispersible polyester resin nor the polycarboxylic acid (Comparative Example 4) or contains the polycarboxylic acid only (Reference Example 1), the results are not satisfactory in regard to the corrosion resistance test conducted after two weeks have passed. On the other hand, the surface-treated aluminum plate containing the polycarboxylic acid of the present invention yields satisfactory results in both the corrosion resistance and the close adhesion during the working (Examples 12 to 17).

Further, when the surface-treating solution contains neither the water-dispersible polyester resin nor the water-dispersible particulate component (Comparative Examples 3 and 5), the corrosion resistance is not satisfactory. Further, when the layer is formed by using the water-dispersible polyester resin and the zirconium compound only (Reference Example 2) or when the layer is formed by using the water-dispersible polyester, polycarboxylic acid and zirconium compound only (Reference Example 3), the corrosion resistance is favorable but the organic resin coating peels off during the heat treatment after the draw-ironing working. On the other hand, the surface-treated aluminum plate containing the particulate component of the present invention does not permit the organic resin coating to peel off, and yields excellent results satisfying workability, closely adhesion and corrosion resistance (Examples 18 to 32).

In the surface-treated aluminum plate of the invention, it is desired that an organic/inorganic ratio (C/M) representing a ratio of the amount of carbon C ($mg/m^2$) deriving from the polyester resin and the amount of zirconium or titanium M ($mg/m^2$) deriving from the zirconium compound or the titanium compound in the conversion-coated layer, is contained in a range of 1 to 80, specifically, 2 to 70 and, more specifically, 10 to 40.

Further, if the conversion-coated layer contains the polycarboxylic acid and/or the particulate component, it is desired that an organic/inorganic ratio (C/M) representing the ratio of the amount C of carbon ($mg/m^2$) deriving from the polyester resin and the polycarboxylic acid and/or the organic particulate component and the amount M of zirconium or titanium ($mg/m^2$) deriving from the zirconium compound or the titanium compound in the conversion-coated layer, lies in a range of 1 to 40 and, specifically, 5 to 30.

If the surface-treated aluminum plate has the ratio C/M lying in the above range, zirconium ions or titanium ions properly deposit during the surface treatment, and form a good conversion-coated layer together with the polyester resin, polycarboxylic acid and/or particulate components. Namely, there can be reliably obtained the surface-treated aluminum plate having excellent corrosion resistance and closely adhesion during the working. If the ratio C/M is smaller than the above range, however, the corrosion resistance becomes slightly poor depending upon the content that is contained. If the ratio C/M exceeds the above range, on the other hand, the surface treatment is done requiring extended periods of time, and the productivity decreases.

Though there is no specific limitation on the amount of the layer that is deposited, it is desired that the amount C of carbon is in a range of 5 $mg/m^2$ to 1,000 $mg/m^2$ and, specifically, 50 $mg/m^2$ to 500 $mg/m^2$. It is, further, desired that the amount M of zirconium or titanium is in a range of 1 mg/m$^2$ to 200 mg/m$^2$ and specifically, 2 mg/m$^2$ to 100 mg/m$^2$. If the amounts are smaller than the above ranges, the aluminum plate is not sufficiently coated and its corrosion resistance becomes poor. If the amounts are larger than the above ranges, on the other hand, properties are not improved despite of an increase in the amount of the film, and the productivity decreases.

How to measure the carbon amount C (mg/m$^2$) and the zirconium or titanium amount M (mg/m$^2$) in the conversion-coated layer will be described later.

If the particulate component is to be contained in the conversion-coated layer, though not specifically limited, it is desired that the ratio of filling the particulate component (particle filling ratio) in the conversion-coated layer is not larger than 40% by weight and, specifically, 3 to 20% by weight. If the particle filling ratio is larger than the above range, the amount of the polyester resin becomes small and it becomes difficult to form a favorable conversion-coated layer. If the particle filling ratio is smaller than the above range, the amount of the particulate component becomes small and the effect due to the particulate component is not obtained to a sufficient degree.

How to calculate the ratio of filling the particulate component (% by weight) will be described later.

In the organic resin-coated surface-treated aluminum plate of the invention, further, the organic resin coating is formed on the conversion-coated layer of the surface-treated aluminum plate. Here, in the invention, the surface-treated aluminum plate and the organic resin coating feature very good and closely adhesion and, therefore, the organic resin coating can be formed directly on the conversion-coated layer without applying any primer or the like.

FIG. 1 is a view showing a structure in cross section of an organic resin-coated surface-treated aluminum plate of the present invention, wherein conversion-coated layers 3 and 3 are formed on both surfaces of an aluminum plate 2, and organic resin films 4 and 4 are formed directly on the conversion-coated layers 3 and 3.

Figure 2:
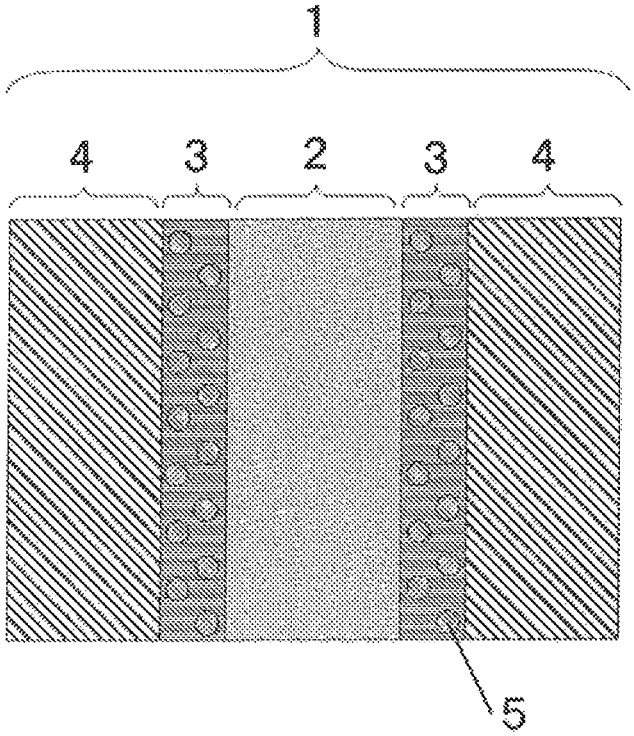
FIG. 2 is a view showing another structure in cross section of the organic resin-coated surface-treated aluminum plate of the present invention.

Further, an organic resin-coated surface-treated aluminum plate of the invention shown in FIG. 2 has a structure in cross section similar to that of FIG. 1. Here, however, a particulate component 5, 5, - - - is dispersed in the conversion-coated layers 3 and 3.

Surface-Treating Solutions

The surface-treating solution used for treating the surfaces of the surface-treated aluminum plate of the invention comprises an aqueous solution which contains a water-dispersible polyester resin, fluorine ions, zirconium ions or titanium ions and, as required, a polycarboxylic acid and a particulate component.

When the surface of the aluminum material is treated by using the above treating solution, aluminum dissolves due to fluorine ions and, as a result, the pH rises causing the zirconium or titanium compound to deposit. Here, it is considered that there also deposits the polyester resin that is present in the form of a dispersion in the surface-treating solution. The aluminum plate or which the surface is treated is washed with water for removing unreached products and is, thereafter, dried; i.e., there is obtained the surface-treated aluminum plate. The polyester resin is thus made present homogeneously on the surface of the aluminum plate together with the zirconium compound or the titanium compound making it possible to provide the conversion-coated layer having excellent corrosion resistance and closely adhesion during the working.

When the polycarboxylic acid is added, the carboxyl group that is present works to improve the adhering property and, further, forms a metal chelate complex with zirconium ions or titanium ions to provide the conversion-coated layer that features very closely adhesion property to the organic resin coating and excellent corrosion resistance. Further, the polycarboxylic acid that is contained works to suppress the zirconium compound or the titanium compound from being excessively deposited during the surface treatment.

When the particulate component is added, further, the surface-treating solution contains the polyester resin as well as the particulate component in the form of a dispersion. Namely, the particulate component suppresses the conversion-coated layer from fluidizing and its anchoring effect, further, improves closely adhering property.

It is desired that the surface-treating solution of the present invention contains the polyester resin in an amount of 100 to 10,000 ppm, specifically, 500 to 10,000 ppm and, more specifically, 1,000 to 5,000 ppm, and contains the zirconium ions or the titanium ions in amount of 5 to 5,000 ppm, specifically, 50 to 2,000 ppm and, more specifically, 50 to 500 ppm.

When the polycarboxylic acid is added, further, it is desired that the polyester resin is contained in an amount of 500 to 10,000 ppm and, specifically, 1,000 to 5,000 ppm, the polycarboxylic acid is contained in an amount of 5 to 2,000 ppm and, specifically, 100 to 1,000 ppm, and the zirconium ions or the titanium ions are contained in an amount of 0 to 5,000 ppm, specifically, 5 to 4,000 ppm and, more specifically, 50 to 1,000 ppm.

Further, when the particulate component is added, it is desired that the polyester resin is contained in an amount of 500 to 10,000 ppm and, specifically, 1,000 to 3,000 ppm, the water-dispersible particulate component is contained in an amount of 100 to 3,000 ppm, the polycarboxylic acid is contained in an amount of 5 to 2,000 ppm and, specifically, 100 to 1,000 ppm, and the zirconium ions or the titanium ions are contained in an amount of 5 to 5,000 ppm and, specifically, 100 to 3,000 ppm.

Upon satisfying the conditions for the surface treatment that will be described later and with the components in the surface-treating solution lying in the above-mentioned ranges, the ratio C/M of the conversion-coated layer contains in the above-mentioned range. If the components are less than the above-mentioned ranges, the amounts of deposition of the polyester resin and the zirconium compound or the titanium compound are not sufficient, and corrosion resistance and adhesiveness are not satisfactory. If the components are larger than the above ranges, on the other hand, the treating solution tends to lose stability without any further improvements in the corrosion resistance, etc. and bringing about disadvantage in economy.

Polyester Resin

As the wafer-dispersible polyester resin used for the surface-treating solution of the invention, there can be exemplified a polyester resin containing a hydrophilic group as a component. The component may stay physically adsorbed on the surface of the polyester dispersion or may, preferably, be copolymerized in the polyester resin skeleton.

As the hydrophilic group, there can be exemplified hydroxyl group, amino group, carboxyl group, sulfonic group, or derivatives thereof, metal salts thereof or ethers thereof, which are contained in the molecules thereof so as to be present in a state of being capable of dispersing in water.

As the monomer containing the hydroxyl group, there can be concretely exemplified metal salts of a hydroxyl group-containing polyether monomer, such as polyethylene glycol, polypropylene glycol, glycerin or polyglycerin, and a sulfonic acid-containing monomer, such as 5-sulfoisophthalic acid, 4-sulfonaphthalene-2,7-dicarboxylic acid, or 5(4-sulfophenoxy)isophthalic acid.

Further, a vinyl monomer having a hydrophilic group may be graft-polymerized with the polyester resin. As the vinyl monomer having a hydrophilic group, there can be exemplified those having carboxyl group, hydroxyl group, sulfonic acid group or amide group. As the group that can be converted into a hydrophilic group, there can be exemplified those having acid anhydride group, glycidyl group or chloro group.

In the invention, the water-dispersible polyester resin, favorably, has a sulfonic acid group as the hydrophilic group.

As other monomer components for forming the water-dispersible polyester resin in combination with a monomer that contains the hydrophilic group, there is no specific limitation if they are the monomers that are usually used for the polyesters. As the polyvalent carboxylic acid, for instance, there can be exemplified aromatic polyvalent carboxylic acids such as phthalic acid, isophthalic acid, terephthalic acid and naphthalenedicarboxylic acid; and aliphatic polyvalent carboxylic acids such as succinic acid, adipic acid, azelaic acid, sebacic acid, cylclohexanedicarboxylic acid and dimeric acid. As the glycol components, there can be exemplified ethylene glycol, propylene glycol, diethylene glycol, triethylene glycol, butylene glycol neopentyl glycol and 1,6-hexanediol.

It is desired that the water-dispersible polyester resins have a glass transition temperature of −40° C. to 140° C. and, more preferably, 20° C. to 120° C. Further, the water-dispersible polyester resins have a number average molecular weight of, preferably, 1,000 to 100,000 and, more preferably, 3,000 to 80,000.

Zirconium Compound or Titanium Compound

As the zirconium compound or the titanium compound capable of feeding zirconium ions or titanium ions to the surface-treating solution, though not limited thereto only, there can be exemplified hexafluorozirconium acid, potassium hexafluorozirconium ($KZrF_6$), ammonium hexafluorozirconium ($(NH_4)_2ZrF_6$), ammonium zirconium carbonate solution ($(NH_4)_2ZrO(CO_3)_2$), zirconium oxynitrate $ZrO(NO_3)_2$, zirconium oxyacetate ($ZrO(CH_3COO)_2$), or hexafluorotitanic acid ($H_2TiF_6$), potassium titanium fluoride ($K_2TiF_6$), ammonium titanium fluoride ($(NH_4)_2TiF_6$), sodium titanium fluoride ($Na_2TiF_6$), potassium titanium oxalic dihydrate ($K_2TiO(C_2O_4)_2.2H_2O$), titanium chloride (III) solution ($TiCl_3$) and titanium chloride (IV) solution ($TiCl_4$).

In the present invention, fluorine ions contained in the surface-treating solution dissolve aluminum enabling the zirconium compound or the titanium compound to be suitably deposited. Of the above, therefore, if there is used the compound other than the compound capable of feeding fluorine ions, there can be used, as a fluorine-contained compound, sodium fluoride (NaF), potassium fluoride (KF) or ammonium fluoride ($NH_4F$) in combination.

Polycarboxylic Acid

As the polycarboxylic acid added to the surface-treating solution of the invention, there can be exemplified a homopolymer or a copolymer of monomers having carboxyl groups, such as polyacrylic acid, polymethacrylic acid, polymaleic acid, polyitaconic acid and acrylic acid/methacrylic acid copolymer, as well as partly neutralized products thereof. Specifically, there can be favorably used polyacrylic acid and polymethacrylic acid.

Particulate Component

There is no specific limitation on the particulate component used in the present invention so far as it exhibits its effect such as corrosion resistance. If it is of the organic type, it is desired to use particles of a crosslinked polymer of which the glass transition temperature cannot be measured under a heating condition of not higher than 300° C. Preferably, there are used crosslinked particles having an ester bond such as of a homopolymer of an alkyl (meth) acrylate ester or a copolymer of alkyl (meth) acrylate ester and other polymerizable monomer copolymerizable therewith.

As the alkyl (meth)acrylate ester, there can be exemplified (meth)acrylic acid esters such as methyl (meth)acrylate, ethyl (meth)acrylate, n-propyl (meth)acrylate, isopropyl (meth)acrylate, n-butyl (meth)acrylate, isobutyl (math)acrylate, t-butyl (meth)acrylate, n-amyl (meth) acrylate, isoamyl (meth)acrylate, octyl (meth)acrylate, 2-ethylhexyl (meth) acrylate, decyl (meth)acrylate, lauryl (meth)acrylate, cyclohexyl(meth)acrylate, benzyl (meth)acrylate, 2-phenoxyethyl (meth)acrylate, and 3-phenylpropyl (meth)acrylate; and hydroxyethyl (meth)acrylate, hydroxypropyl (meth)acrylate, (meth)acrylic acid and glycidyl (meth)acrylate.

As the other polymerizable monomers copolymerizable with the alkyl (meth)acrylate ester, there can be exemplified styrenes such as styrene, α-methylstyrene, paramethylstyrene, isopropenylstyrene and chlorostyrene; unsaturated nitriles such as acrylonitrile, methacrylonitrile, ethacrylonitrile and phenylacrylonitride; (meth)acrylic acid, itaconic acid, maleic acid, fumaric acid or half-esterified products thereof; vinyltoluene; and epoxy group-containing monomer such as allylglycidyl ether.

Further, the crosslinkrng agent may be any monomer having a plurality of polymerizable double bonds in a molecule thereof. Though not limited thereto only, examples thereof will be (meth)acrylic acid ester type polyfunctional monomers such as ethylene glycol di(meth)acrylate, diethylene glycol di(meth)acrylate, triethylene glycol di(meth) acrylate, nonaethylene glycol di(meth)acrylate, decaethylene glycol di(meth)acrylate, tetradecaethylene glycol di(meth)acrylate, pentadecaethylene glycol di(meth)acrylate, 1,3-butylene glycol di(meth)acrylate, 1,4-butanediol di(meth)acrylate, 1,6-hexanediol di(meth)acrylate, glycerin di(meth)acrylate, trimethylolpropane tri(meth)acrylate, pentaerythritol tetra(meth)acrylate, diethylene phthalate glycol di(meth)acrylate, caprolactone-modified dipentaerythritol hexa(meth)acrylate, caprolactone-modified hydroxypivarate ester neopentyl glycol diacrylate, polyfunctional polyester acrylate, and polyfunctional urethane acrylate; and aromatic vinyl type polyfunctional monomers such as divinylbenzene and derivatives thereof, and divinylnaphthalene and derivatives thereof.

As the polymerization initiator for the alkyl (meth)acrylate ester and the crosslinking agent, there can be used any one known per se. Not being limited thereto only, however, there can be further used a hydrogen peroxide type polymerization initiator, organic or inorganic peroxide type polymerization initiator and azo type polymerization initiator.

Further, though not specifically limited, it is desired that the inorganic particulate component comprises a silica compound. As for the shape and kind of the silica particles, there can be mentioned spherical silica, chain-like silica and aluminum-modified silica. Concretely, there can be exemplified colloidal silica as spherical silica, such as Snowtex N, Snowtex UP (manufactured by Nissan Kagaku Kogyo Co.) and LUDOX (manufactured by W.R. Grace Co.), as well as fumed silica such as Aerosil (manufactured by Nihon Aerosil Co.). As the chain-like silica, there can be exemplified such silica gel as Snowtex PS manufactured by Nissan Kagaku Kogyo Co.) and as the aluminum-modified silica, there can be exemplified a commercially available silica gel such as Aderaito AT-20A (manufactured by Asahi Denka Kogyo Co.).

In the present invention, in particular, there can be preferably used crosslinked particles of a homopolymer of methyl poly(meth)acrylate, crosslinked particles of a copolymer of methyl (meth)acrylate and (meth)acrylic acid, or particles of an inorganic silica compound.

Crosslinked particles comprising chiefly the methyl poly (meth)acrylate as represented by the polymethyl methacrylate and the particles of the inorganic silica compound have excellent mechanical strength, transparency, weather-proof property and hygienic properties and, besides, are capable of effectively suppressing the delamination that occurs during the step of heat treatment as demonstrated in Examples described later.

The particulate component used in the invention has an average particle size in a range of, desirably, 1 to 200 nm and, specifically, 5 to 80 nm. If the average particle size is smaller than the above range, the crosslinked particles become no longer capable of effectively suppressing the conversion-coated layer from fluidizing or of exhibiting the anchoring effect to a sufficient degree. If the average particle size is larger than the above range, on the other hand, the particulate component cannot be sufficiently fixed by the polyester resin. In either case, therefore, close adhesion during the working cannot be sufficiently improved as compared to if the average particle size lies within the above-mentioned range.

The surface-treating solution of the present invention does not necessarily have to be blended with a surfactant for dispersing the polyester resin or with an oxidizing agent. Namely, the surface-treating solution can be prepared by blending water or an aqueous medium comprising water and a small amount of organic solvent with
the water-dispersible polyester resin and the zirconium compound or the titanium compound in such amounts that the polyester resin and the zirconium ions or titanium ions are present therein at the above-mentioned concentrations.

If fluorine ions are to be made present in the surface-treating solution, it is desired that the concentration of fluorine ions is in a range of 5 to 500 ppm. If the concentration of fluorine ions is lower than the above range, the etching effect by the fluorine ions cannot be obtained. If the concentration of fluorine ions is higher than the above range, on the other hand, the efficiency of deposition may rather be impaired.

Surface-Treating Method

The surface of the aluminum plate can be treated by using the surface-treating solution of the present invention. Namely, use is made of the surface-treating solution that is obtained by blending the aqueous medium with the above-mentioned water-dispersible polyester resin and the zirconium compound or the titanium compound and, as required, with the polycarboxylic acid and the particulate component in such amounts that the concentrations thereof lie in the above-mentioned ranges, and the aluminum plate is treated by dipping, by spraying or by using a roll coater.

It is desired that the pH of the surface-treating solution contains in a range of 1.0 to 4.0 and, specifically, 1.5 to 4.0, and is, as required, adjusted by adding nitric acid or ammonia. If the pH is smaller than the above range, the layer is not formed sufficiently. If the pH is larger than the above range, on the other hand, stability of the treating solution becomes poor, the layer is formed at a decreased rate, and the productivity decreases.

Though not specifically limited, the temperature of the surface-treating solution lies, desirably, in a range of 35 to 70° C. from the standpoint of forming the layer maintaining stability.

Prior to being dipped in the surface-treating solution, the aluminum plate is dewaxed and washed with water in a customary manner and is, as required, subjected to the etching, washing with water and, further, to the pretreatment such as washing with acid and with water. Next, the aluminum plate is dipped in the sur face-treating solution having the pH and the temperature adjusted to lie in the above ranges for 2 to 20 seconds, or is spray-treated with the surface-treating solution, followed by washing with water and drying to obtain the surface-treated aluminum plate having the conversion-coated layer formed thereon.

There can be used any aluminum plate that has heretofore been used as a material for producing cans. It may be an aluminum alloy plate as well as a pure aluminum plate and may, desirably, have a thickness in a range of 100 to 500 μm though not limited thereto only.

Further, depending on the surface-treating method, aluminum of the base plate may dissolve, and the conversion-coated layer may often contain an aluminum compound.

Organic Resin-Coated Surface-Treated Aluminum Plate

The organic resin-coated surface-treated aluminum plate of the present invention has a layer of the organic resin applied onto the conversion-coated layer of the above surface-treated aluminum plate. Upon using the above-mentioned surface-treated aluminum plate, therefore, the organic resin-coated surface-treated aluminum plate features very good closely adhesion property to the organic resin coating and, specifically, very good close adhesion during the working providing, therefore, excellent corrosion resistance and dent resistance.

In the organic resin-coated surface-treated aluminum plate of the present invention, there is no specific limitation on the organic resin formed on the conversion-coated layer, and there can be formed a film of a thermoplastic resin or a film of a thermosetting or thermoplastic resin.

As the films formed from the thermoplastic resins, there can be exemplified olefin resin films such as of polyethylene, polypropylene, ethylene/propylene copolymer, ethylene/vinyl acetate copolymer, ethylene/acrylic ester copolymer and ionomer; polyester film such as of polyethylene terephthalate; polyamide films such as of nylon 6, nylon 6,6, nylon 11 and nylon 12; polyvinyl chloride film and polyvinylidene chloride film. The thermoplastic resin film may not have been stretched or may have been biaxially stretched.

As the coating material capable of forming the coating, further, there can be exemplified modified epoxy coating materials such as phenol-epoxy and amino-epoxy; and synthetic rubber coating materials such as vinyl chloride/vinyl acetate copolymer, saponified product of vinyl chloride/vinyl acetate copolymer, vinyl chloride/vinyl acetate/maleic anhydride copolymer, epoxy-modified, epoxyamino-modified, or epoxyphenol-modified vinyl coating material or modified vinyl coating material, acrylic coating material, polyester coating material, and styrene/butadiene copolymer, which may be used in a combination of two or more kinds.

Among them, a film which is one polyester resin film is most favorably used as a material for producing cans.

As the polyester resin, there can be used a homopolyethylene terephthalate, too, as a matter of course, From the standpoint of shock resistance and workability, however, it is desired to lower a maximum crystallinity which the film can assume. For this purpose, it is desired to introduce into the polyester the copolymerized ester units other than the ethylene terephthalate.

In the copolymerized polyester, in general, it is desired that not less than 70 mol % and, specifically, not less than 75 mol % of the dibasic acid component comprises the terephthalic acid component, not less than 70 mol % and, specifically, not less than 75 mol % of the diol component comprises the ethylene glycol, and 1 to 30 mol % and, specifically, 5 to 25 mol % of the dibasic acid component comprises the dibasic acid component other than the terephthalic acid.

As the dibasic acid other than the terephthalic acid, there can be exemplified aromatic dicarboxylic acids such as isophthalic acid, phthalic acid and naphthalenedicarboxylic acid; alicyclic dicarboxylic acids such as cyclohexanedicarboxylic acid and the like acid; and aliphatic dicarboxylic acids such as succinic acid, adipic acid, sebacic acid and dodecanedioic acid; which may be used in one kind or in a combination of two or mere kinds. As the diol component other than the ethylene glycol or the butylene glycol, there can be exemplified propylene glycol, diethylene glycol, 1,6-hexylene glycol, cyclohexane dimethanol and ethylene oxide adduct of bisphenol A, which may be used in one kind or in a combination of two or more kinds.

To improve the melt-fluidizing properties during the forming, further, the polyester resin can contain at least one kind of a branched or crosslinked component selected from the group consisting of trifunctional or more highly functional polybasic acids and polyhydric alcohols. It is desired that the branched or crosslinked components are contained in an amount of not more than 3.0 mol % and, preferably, in a range of 0.05 to 3.0 mol %.

As the trifunctional or more highly functional polybasic acids and polyhydric alcohols, there can be exemplified such polybasic acids as trimellitic acid, pyromellitic acid hemimellitic acid, 1,1,2,2-ethanetetracarboxylic acid, 1,1,2-ethanetricarboxylic acid, 1,3,5-pentanetricarboxylic acid, 1,2,3,4-cyclopentanetetracarboxylic acid, biphenyl-3,4,3',4'-tetracarboxylic acid, and such polyhydric alcohols as pentaerythritol, glycerol, trimethylolpropane, 1,2,6-hexanetriol, sorbitol and 1,1,4,4-tetrakis(hydroxyethyl)cyclohexane.

The homopolyester or the copolymerized polyester should have a molecular weight in a range in which a film can be formed, and should have an intrinsic viscosity [η] in a range of 0.5 to 1.5 and, specifically, 0.6 to 1.5 as measured by using, as the solvent, a phenol/tetrachloroethane mixed solvent.

The polyester resin layer that serves as the organic resin coating of the present invention may be a single resin layer or a plurality of resin layers formed by simultaneous extrusion. Use of the plurality of polyester resin layers is advantageous since it permits a polyester resin of a composition having excellent adhering property to be used as the underlying layer, i.e., to be formed on the side of the surface-treated aluminum plate and permits a polyester resin to be used as the surface layer, the polyester resin being a composition having excellent resistance against the content, i.e., having excellent resistance against being eluted out and property of not adsorbing flavoring components.

The above polyester resin layer can be blended with known blending agents for resins, such as anti-blocking agent like amorphous silica, as well as with inorganic filler, various antistatic agents, lubricant, antioxidant and ultraviolet-ray absorber according to a known recipe.

In the present invention, it is desired that the organic resin coating has a thickness of, usually, in a range of 3 to 50 μm if it is a coating of a thermoplastic resin such as polyester resin, or is applied in an amount of 0.5 to 20 g/m$^2$ if it is a coating formed by the application. If the thickness of the organic resin coating is smaller than the above range, the corrosion resistance is not sufficient. If the thickness thereof is larger than the above range, on the other hand, problem easily occurs in regard to workability.

Production of the Organic Resin-Coated Surface-Treated Aluminum Plate

In the invention, the surface-treated aluminum plate can be coated with the organic resin by any means. For instance, the polyester resin coating can be formed by the extrusion coating method, cast film heat-adhesion method or biaxially stretched film heat-adhesion method. In the case of applying the thermosetting coating material, the coating can be formed by a known method such as the roll-coating method or spray method.

In the invention as described above, further, the organic resin coating on the surface-treated aluminum plate has very good closely adhering property, and there is no need of providing a coating such as primer for adhesion between the conversion-coated layer and the organic resin coating which is specifically the coating of the polyester. This, however, is not to exclude the provision of such coating, and there may be formed a known primer coating such as phenol epoxy coating material having very good closely adhesion property and corrosion resistance either on the surface-treated aluminum plate or on the polyester film.

Can Body

The can body of the invention can be formed by any known can-making method so far as it is formed by using the above-mentioned organic resin-coated surface-treated aluminum plate, and may be a three-piece can having a seam on the side surface but is, usually and desirably, a seamless can (two-piece can). The seamless can is produced by a known means such as draw·redraw working, bend·stretch working (stretch working) by draw·redrawing, bend·stretch·ironing working by draw·redrawing or draw·ironing working.

Can Lid

The can lid of the invention can be formed by any known lid-making method so far as it is formed by using the above-mentioned organic resin-coated surface-treated aluminum plate. Usually, it may be an easy-open can lid of the stay·on·fab type or an easy-open cars lid of the full·open type.

EXAMPLES

The invention will be further described by way of the following Examples which, however, are in no way to limit the invention. Described below are the methods of testing sample plates used in Examples and comparative Examples.

Amount of Carbon

The amount of carbon atoms deriving from the polyester resin, polycarboxylic acid and organic particulate component in the conversion-coated layer was measured by using an X-ray fluorescene analyzer. The calibration curve used for the measurement was obtained by applying and heating an aqueous solution of a water-dispersible polyester of a known concentration onto a clean aluminum alloy to prepare a known standard plate, and by finding a correlation between the fluorescene X-ray intensity and the measured amount of carbon.

Amount of Zirconium or Titanium

The amount of zirconium or titanium deriving from the zirconium or titanium compound in the conversion-coated layer was measured by using the X-ray fluorescene analyzer. The calibration curve was obtained by preparing a zirconium deposited standard plate of which the amount of the film has been known, and by finding a correlation between the fluorescene X-ray intensity and the amount of the layer.

Method of Calculating the Organic/Inorganic Ratio

The organic/inorganic ratio is represented by the ratio of the amount C of carbon deriving from the polyester resin, polycarboxylic acid and organic particulate component in the conversion-costed layer and the amount M of zirconium or titanium deriving from the zirconium or titanium compound in the conversion-coated layer. Namely, the organic/inorganic ratio is found by calculating, in compliance with the following formula, the amount of the layer obtained by the X-ray fluorescene.

$$\text{Organic/inorganic ratio} = C/M(-)$$

C: The amount of carbon ($mg/m^2$) in the conversion-coated layer.

M: The amount of zirconium or titanium ($mg/m^2$) in the conversion-coated layer.

Measuring Conditions for the X-Ray Fluorescene Analyzer

Equipment used: ZSX100e manufactured by Rigaku Denki Co.

Measuring conditions: Objects to be measured, Zr-Kα ray, C-Kα ray
Diameter to be measured, 20 mm
X-ray output, 50 kV-70 mA
Measuring time, 20 sec. (Zr)
100 sec. (C)

Corrosion Resistance Test 1

The surface-treated aluminum plates prepared in Examples 1 to 11 and Comparative Examples 1 to 3 were tested for their corrosion resistance by treating them with heat at 210° C. for 180 seconds, dipping them in an acidic aqueous solution containing chloride ions, and observing a change in properties with the passage of time. If the aluminum sample plates were lacking corrosion resistance, then the metal substrate could dissolve at the exposed portions and could form a metal compound due to corrosion. Therefore, the corrosion resistance was evaluated by confirming white rust caused by them.

A model aqueous solution used for the test was the one that contained the salt at a concentration of 1000 ppm, and to which the citric acid was added so that the pH was adjusted to be 3.0. Further, the temperature was maintained at 37° C. at the time of the test.

Corrosion resistance was good: When the aluminum sample plate was superior to the chromic phosphate-treated plate as observed after one week has passed.

Corrosion resistance was not good: When the aluminum sample plate was comparable to or inferior to the chromic phosphate-treated plate as observed after one week has passed.

Corrosion Resistance Test 2

The surface-treated aluminum plates prepared in Examples 12 to 17, Reference Example 1 and Comparative Examples 3 and 4 were tested for their corrosion resistance by treating them with heat at 210° C. for 180 seconds, dipping them in an acidic aqueous solution containing chloride ions, and observing a change in properties with the passage of time. If the aluminum sample plates were lacking corrosion resistance, the metal substrate could dissolve at the exposed portions and could form a metal compound due to corrosion. Therefore, the corrosion resistance was evaluated by confirming white rust caused by them.

A model aqueous solution used for the test was the one that contained the salt at a concentration of 1000 ppm, and to which the citric acid was added so that the pH was adjusted to be 3.0. Further, the temperature was maintained at 37° C. at the time of the test.

Corrosion resistance was good: When the aluminum sample plate developed no white rust as observed after two weeks have passed.

Corrosion resistance was not good: When the aluminum sample plate developed white rust as observed after two weeks have passed.

Corrosion Resistance Test 3

The surface-treated aluminum plates prepared in Examples 13 to 32, Comparative Examples 3 and 5, and Reference Examples 2 and 3 were tested for their corrosion resistance by forming can bodies in a manner as described in Examples, heat-treating the can bodies at 210° C. for 180 seconds, filling the cans with an acidic model aqueous solution containing chloride ions, lowering the temperature of the cans down to 5° C. over a period of one day or longer, permitting a metal mass weighing 1 kg to vertically fall from a height of 4 cm on the metal can that is laid horizontally at a position 1 cm from the lower part of the can side wall to make the can dented due to the impact. Namely, the sample cans were prepared as described above and were evaluated for their shock resistance and corrosion resistance. If the surface-treated aluminum sample plates were lacking corrosion resistance or dent resistance, then the metal substrates could dissolve at the exposed portions and a metal compound could be formed due to corrosion. Therefore, the area of white rust caused by them was observed, and the corrosion resistance was evaluated by confirming the corroded areas.

A model aqueous solution used for the test was the one that contained the salt at a concentration of 1000 ppm, and to which the citric acid was added so that the pH was adjusted to be 3.0. Further, the corrosion resistance at the dented portions was evaluated after the sample cans were stored at a temperature of 37° C. for one month.

If the area of white rust occurred at the dented portion was comparable to, or smaller than, that of the existing chromic phosphate-treated product (Comparative Example 3) after the passage of one month, the result was evaluated to be "good" regarding that the corrosion resistance could be improved and if the area of white rust was larger, the result was evaluated to be "not good" regarding that there was no improvement in the corrosion resistance.

Evaluating the Close Adhesion During the Working

The can bodies prepared in Examples 1 to 17, Comparative Examples 1 to 4 and Reference Example 1 were cut at their can side walls over the portions of a height of 45 mm to 95 mm from the can bottoms into short strips of a width of 15 mm. The short strips were scratched on the outer surface side of the can into a depth to reach the blank at a position 35 mm away from the ends (corresponds to a position of a height of 80 mm from the can bottom). With the scratch as a start point, the short strips were folded repetitively so that the metal pieces only were broken yet leaving the resin film to be still linked together. Next, by using a peel tester and with the linked portion on the inner surface side, the 180-degree peeling test was conducted at 23° C. and a tension speed of 5 mm/min to measure the strength of adhesion.

The results were evaluated to be:

Closely adhering force after the working was good: When the strength of adhesion was not less than 1.0 N/15 mm.

Closely adhering force after the working was not good: When the strength of adhesion was less than 1.0 N/15 mm.

Method of Confirming the Metal Chelate Complex

The metal chelate complex in the conversion-coated layer on the surface-treated aluminum plate was confirmed by using a Fourier transform infrared spectroscopy. Upon being composited with metal ions, the carboxylic acid transforms into a carboxylate thereof. It has been known that the carboxylic acid has characteristic absorption bands, usually, over the wavelengths of nearly 920 to 970 $cm^{-1}$, nearly 1700 to 1710 $cm^{-1}$ and nearly 2500 to 3200 $cm^{-1}$. It has also been known that the carboxylate has characteristic absorption bands over the wavelengths of nearly 1480 to 1630 $cm^{-1}$. Upon confirming their peak shifts, the metal chelate complex could be confirmed.

Measuring Conditions for the Fourier Transform Infrared Spectroscopy

Equipment used: FTS 7000 Series manufactured by Digilab Co.

Measuring method: One-time reflection method using a germanium prism

Wavelength region for measurement: 4000 to 700 $cm^{-1}$

Filling Ratio of the Particulate Component

The filling ratio of the particulate component was found by obtaining an image using an ordinary scanning electron microscope measuring apparatus (S-4800 manufactured by Hitachi, Ltd.), counting the number of particles per a unit area to find a volume of the particulate component, converting the volume into a weight, and dividing the weight by the total weight.

$$\text{Filling ratio of particles} = A/B \times 100 \text{ (wt \%)}$$

A: Weight of the particulate component in the conversion-coated layer ($mg/m^2$)

B: Weight of the whole organic components in the conversion-coated layer ($mg/m^2$)

Evaluating the Close Adhesion During the Heat-Treatment of the Metal Cans

The surface-treated aluminum plates prepared in Examples 18 to 32, Comparative Examples 3 and 5, and Reference Examples 2 and 3 were evaluated for their close adhesion during the heat treatment by forming can bodies in a manner as described in Examples and heat-treating them by using an oven for laboratory use at 210° C. for 180 seconds prior to effecting the necking and flanging.

In conducting the heat treatment, the case was evaluated to be "good" when the organic resin coating was not delaminated from the end surface at the mouth of the metal can, and the case when the organic resin coating was delaminated was evaluated to be "not good".

Example 1

An aluminum alloy plate (material 3104) was provided and was dewaxed by dipping it in an aqueous solution (50° C.) containing 2% of a dewaxing agent (Surf-Cleaner EC371) (trade name) manufactured by Nippon Paint Co. for 6 seconds. After the dewaxing, the aluminum alloy plate was washed with water and was etched with an alkali by dipping it in an aqueous solution (50° C.)) containing 2% of an etching agent [Surf-Cleaner 420N-2] (trade name) manufactured by Nippon Paint Co. for 6 seconds. After the etching, the aluminum alloy plate was washed with water and was, further, washed with an acid by dipping it in an aqueous solution (50° C.) containing 2% of sulfuric acid for 6 seconds.

After the washing with water, the aluminum alloy plate was dipped for 6 seconds in a surface-treating solution (50° C.) prepared by adding into pure water a water-dispersible polyester resin A (Vylonal MD2000, Tg=67° C., manufactured by Toyofco Co.) and a zirconium compound (Hexafluorozirconate manufactured by Aldrich Co.) in such amounts that the polyester resin A was 5000 ppm and the zirconium ions were 50 ppm to thereby form a conversion-coated layer thereon. Thereafter, the aluminum alloy plate was washed with water and air-dried to obtain a surface-treated aluminum plate.

The thus prepared surface-treated aluminum plate was heated in advance at 250° C., and on both surfaces of the aluminum plate was thermally press-adhered, as an organic resin coating, a polyethylene terephthalate film in which 15 mol % of the isophthalic acid has been copolymerized (film thickness of 16 μm) by using laminate rolls followed immediately by cooling with water to obtain an organic resin-coated surface-treated aluminum plate.

The paraffin wax was electrostatically applied onto both surfaces of the obtained organic resin-coated surface-treated aluminum plate which was then punched into a circle 156 mm in diameter, and from which a shallow-drawn cup was prepared. Next, the shallow-drawn cup was subjected to the redraw-ironing working, to the doming and, further, to the trimming for the edge at the opening thereof to thereby obtain a can body. The specifications of the can body were as follows:

Diameter of the can body: 66 mm

Height of the can body: 168 mm

Average plate thickness reduction ratio of the can side wall to the initial plate thickness: 60%

Example 2

A surface-treated aluminum plate, an organic resin-coated surface-treated aluminum plate and a can body were obtained in the same manner as in Example 1 but changing the amount of the zirconium ions in the treating solution into 100 ppm.

Example 3

A surface-treated aluminum plate, an organic resin-coated surface-treated aluminum plate and a can body were obtained in the same manner as in Example 1 but changing the amount of the zirconium ions in the treating solution into 150 ppm.

Example 4

A surface-treated aluminum plate, an organic resin-coated surface-treated aluminum plate and a can body were obtained in the same manner as in Example 1 but changing the amount of the zirconium ions in the treating solution into 250 ppm.

Example 5

A surface-treated aluminum plate, an organic resin-coated surface-treated aluminum plate and a can body were obtained in the same manner as in Example 1 but changing the amount of the zirconium ions in the treating solution into 500 ppm.

Example 6

A surface-treated aluminum plate, an organic resin-coated surface-treated aluminum plate and a can body were obtained in the same manner as in Example 1 but changing the amount of the zirconium ions in the treating solution into 2000 ppm.

Example 7

A surface-treated aluminum plate, an organic resin-coated surface-treated aluminum plate and a can body were obtained in the same manner as in Example 1 but changing the amount of the water-dispersible polyester resin A in the treating solution into 1000 ppm and the amount of the zirconium ions into 500 ppm.

Example 8

A surface-treated aluminum plate, an organic resin-coated surface-treated aluminum plate and a can body were obtained in the same manner as in Example 1 but changing the amount of the zirconium ions in the treating solution into 100 ppm and changing the treating time into 10 seconds.

Example 9

A surface-treated aluminum plate, an organic resin-coated surface-treated aluminum plate and a can body were obtained in the same manner as in Example 1 but changing the water-dispersible polyester resin A into a water-dispersible polyester resin B (Plascoat Z687, Tg=110° C., manufactured by Goo Chemical Co.), and adjusting the amount of the polyester B in the treating solution to be 3000 ppm and the amount of the zirconium ions to be 500 ppm.

Example 10

A surface-treated aluminum plate, an organic resin-coated surface-treated aluminum plate and a can body were obtained in the same manner as in Example 1 but changing the water-dispersible polyester resin A into a water-dispersible polyester resin C (Vylonal MD1480, Tg=20° C., manufactured by Toyobo Co.), and adjusting the amount of the polyester resin C in the treating solution to be 5000 ppm and the amount of the zirconium ions to be 500 ppm.

Example 11

A surface-treated aluminum plate, an organic resin-coated surface-treated aluminum plate and a can body were obtained in the same manner as in Example 1 but changing the zirconium compound into a titanium compound (Hexafluorotitanic acid" manufactured by Aldrich Co.), adjusting the amount of the titanium ions to be 500 ppm and changing the treating time into 10 seconds.

Comparative Example 1

A surface-treated aluminum plate, an organic resin-coated surface-treated aluminum plate and a can body were obtained in the same manner as in Example 1 but using no water-dispersible polyester resin and adjusting the zirconium ions to be 500 ppm.

Comparative Example 2

The aluminum alloy plate (material 3104) was dewaxed, etched, and washed with the acid in the same manner as in Example 1, followed by washing with water and drying. Thereafter, by using a bar coater, the water-dispersible polyester resin A was applied thereon in such an amount that the weight thereof after dried was as shown in Table 1, and was baked in a hot-air furnace under the conditions of 100° C.×60 seconds followed by drying to obtain a polyester resin A-coated aluminum plate. An organic resin-coated surface-treated aluminum plate and a can body were obtained in the same manner as in Example 1 but using the aluminum plate obtained above.

Comparative Example 3

An organic resin-coated surface-treated aluminum plate and a can body were obtained in the same manner as in Example 1 but using a chromic phosphate-treated plate available in the market.

Table 1 shows the tested and evaluated results of Examples and Comparative Examples.

TABLE 1

| | Organic component | | Inorganic acid component | | Treating | amount of layer | | Org/inorg | | Adhesion |
|---|---|---|---|---|---|---|---|---|---|---|
| | Kind | Amount (ppm) | Kind | Amount (ppm) | time (sec) | (mg/m²) M | (mg/m²) C | ratio (C/M) | Corrosion resistance | during working |
| Ex. 1 | *1 | 5000 | *4 | 50 | 6 | 3 | 185 | 62 | good | good |
| Ex. 2 | *1 | 5000 | *4 | 100 | 6 | 8 | 273 | 34 | good | good |
| Ex. 3 | *1 | 5000 | *4 | 150 | 6 | 14 | 325 | 23 | good | good |
| Ex. 4 | *1 | 5000 | *4 | 250 | 6 | 22 | 331 | 15 | good | good |
| Ex. 5 | *1 | 5000 | *4 | 500 | 6 | 31 | 298 | 10 | good | good |
| Ex. 6 | *1 | 5000 | *4 | 2000 | 6 | 51 | 302 | 6 | good | good |
| Ex. 7 | *1 | 1000 | *4 | 500 | 6 | 30 | 108 | 4 | good | good |
| Ex. 8 | *1 | 5000 | *4 | 100 | 10 | 12 | 330 | 28 | good | good |
| Ex. 9 | *2 | 3000 | *4 | 500 | 6 | 30 | 276 | 9 | good | good |
| Ex. 10 | *3 | 5000 | *4 | 500 | 6 | 32 | 62 | 2 | good | good |
| Ex. 11 | *1 | 5000 | *5 | 500 | 10 | 43 | 420 | 10 | good | good |
| Comp. Ex. 1 | — | — | *4 | 500 | 6 | 35 | 0 | — | not good | good |
| Comp. Ex. 2 | polyester resin A-coated plate | | | | | 0 | 470 | — | good | not good |
| Comp. Ex. 3 | chromic phosphate-treated plate | | | | | 20 (Cr) | | — | not good | not good |

*1: polyester resin A,
*2: polyester resin B,
*3: polyester resin C,
*4: zirconium ions,
*5: titanium ions Table 1 tells that the surface-treated aluminum plates of the present invention have corrosion resistance and close adhesion during the working that are superior in the regions shown in Examples 1 and 11 to those of the chromic phosphate-treated plate that has heretofore been used as a material for producing cans.

Example 12

An aluminum alloy plate (material 3004) was provided and was dewaxed by dipping it in an aqueous solution (50° C.) containing 2% of the dewaxing agent [Surf-Cleaner EC371] (trade name) manufactured by Nippon Paint Co. for 6 seconds. After the dewaxing, the aluminum alloy plate was washed with water and was etched with an alkali by dipping it in an aqueous solution (50 C.) containing 2% of the etching agent [Surf-Cleaner 420N-2] (trade name) manufactured by Nihon Paint Co. for 6 seconds. After the etching, the aluminum alloy plate was washed with water and was, further, washed with the acid by dipping it in an aqueous solution (50° C.) containing 2% of sulfuric acid for 6 seconds.

After the washing with the acid and water, the aluminum alloy plate was dipped for 6 seconds in a surface-treating solution prepared by adding, into pure water, a water-dispersible polyester resin (Vylonal MD2000 manufactured by Toyo Boseki Co.), a polycarboxylic acid (polyacrylic acid "Julimer 10 LHP" manufactured by Toa Gosei Co.) and a zirconium compound (Hexafluorozirconate manufactured by Aldrich Co.) in such amounts that the polyester was 5000 ppm, the polyacrylic acid was 100 ppm and the zirconium ions were 200 ppm and, as required, adding nitric acid or ammonia thereto to adjust the pH to be 1.8, to thereby form a conversion-coated layer thereon. Thereafter, the aluminum alloy plate was washed with water to obtain a surface-treated aluminum plate.

The thus prepared surface-treated aluminum plate was heated in advance at 250° C., and on both surfaces of the aluminum plate was thermally press-adhered a polyethylene terephthalate film in which 15 mol % of the isophthalic acid has been copolymerized (film thickness of 16 μm) by using laminate rolls followed immediately by cooling with water to obtain an organic resin-coated surface-treated aluminum plate.

The paraffin wax was electrostatically applied onto both surfaces of the obtained organic resin-coated surface-treated aluminum plate which was then punched into a circle 156 mm in diameter, and from which a shallow-drawn cup was prepared. Next, the shallow-drawn cup was subjected to the redraw-ironing working, to the doming and, further, to the trimming for the edge at the opening thereof to thereby obtain a can body. The specifications of the can body were as follows:

Diameter of the can body: 66 mm
Height of the can body: 168 mm
Average plate thickness reduction ratio of the can side wall to the initial plate thickness: 60%

Example 13

A surface-treated aluminum plate, an organic resin-coated surface-treated aluminum plate and a can body were obtained in the same manner as in Example 12 but changing the amount of the zirconium ions in the treating solution into 500 ppm.

Example 14

A surface-treated aluminum plate, an organic resin-coated surface-treated aluminum plate and a can body were obtained in the same manner as in Example 12 but changing the amount of the zirconium ions in the treating solution into 1000 ppm.

Example 15

A surface-treated aluminum plate, an organic resin-coated surface-treated aluminum plate and a can body were obtained in the same manner as in Example 12 but changing the amount of the polyester in the treating solution into 2500 ppm, the amount of the polyacrylic acid into 200 ppm, and the amount of the zirconium ions into 500 ppm.

Example 16

A surface-treated aluminum plate, an organic resin-coated surface-treated aluminum plate and a can body were obtained in the same manner as in Example 12 but changing the amount of the polyacrylic acid in the treating solution into 800 ppm and the amount of the zirconium ions into 1000 ppm.

Example 17

A surface-treated aluminum plate, an organic resin-coated surface-treated aluminum plate and a can body were obtained in the same manner as in Example 12 but changing the amount of the polyacrylic acid into 800 ppm and the amount of the zirconium ions into 4000 ppm.

Reference Example 1

A surface-treated aluminum plate, an organic resin-coated surface-treated aluminum plate and a can body were obtained in the same manner as in Example 12 but adding no polyacrylic acid to the treating solution and changing the amount of the zirconium ions into 500 ppm.

Comparative Example 4

A surface-treated aluminum plate, an organic resin-coated surface-tree fed aluminum plate and a can body were obtained in the same manner as in Example 13 but adding neither the polyester nor the polyacrylic acid to the treating solution.

Table 2 shows the tested and evaluated results of Examples and Comparative Examples.

Table 2 tells that the surface-treated aluminum plates of the present invention have very excellent corrosion resistance in the regions shown in Examples 12 to 17, i.e., in the regions where the organic/inorganic ratio is not less than 1.0. Besides, the obtained layers have larger close adhesion after the working than that of the chromic phosphate-treated plate that has heretofore been used as a material for producing cans, and provide the organic resin-coated surface-treated aluminum plates with excellent workability. On account or the above reasons, it can be said that the surface-treated aluminum plates of the invention are practically very useful for producing can bodies and can lids that must endure severe working conditions and must protect the metal plate therein.

Example 18

An aluminum alloy plate (material 3104) was provided and was dewaxed by dipping it in an aqueous solution (50° C.) containing 2% of the dewaxing agent [Surf-Cleaner EC371](trade name) manufactured by Nippon Paint Co. for 6 seconds. After the dewaxing, the aluminum alloy plate was washed with water and was etched with an alkali by dipping it in an aqueous solution (50° C.) containing 2% of the etching agent [Surf-Cleaner 420N-2](trade name) manufactured by Nippon Paint Co. for 6 seconds. After the etching, the aluminum alloy plate was washed with water and was, further, washed with the acid by dipping it in an aqueous solution (50° C.) containing 2% of sulfuric acid for 6 seconds.

After the washing with the acid and water, the aluminum alloy plate was dipped for 10 seconds in a surface-treating solution prepared by adding, into pure water, a water-dispersible polyester resin (Vylonal MD2000, particle size of 135 nm, manufactured by Toyobo Co.) as a main agent, crosslinked PMMA particles A (crosslinked methyl polymethacrylate particles, "Epostar 050W", particle site of 74 nm, manufactured by Nippon Shokubai Go.) as a par-

TABLE 2

| | Organic component | | *1 | | Inorganic acid component | | | Metal | | | | | | Close adhesion during |
|---|---|---|---|---|---|---|---|---|---|---|---|---|---|---|
| | Kind | Amount (ppm) | Kind | Amount (ppm) | Kind | Amount (ppm) | *2 | chelate complex | *3 M | *3 C | *4 (C/M) | Corrosion resistance | *5 | the working |
| Ex. 12 | *6 | 5000 | *7 | 100 | *8 | 200 | 6 | yes | 12 | 263 | 21.9 | good | 2.1 | good |
| Ex. 13 | *6 | 5000 | *7 | 100 | *8 | 500 | 6 | yes | 29 | 370 | 12.8 | good | 1.9 | good |
| Ex. 14 | *6 | 5000 | *7 | 100 | *8 | 1000 | 6 | yes | 64 | 310 | 4.8 | good | 1.7 | good |
| Ex. 15 | *6 | 2500 | *7 | 200 | *8 | 500 | 6 | yes | 28 | 200 | 7.1 | good | 1.7 | good |
| Ex. 16 | *6 | 5000 | *7 | 800 | *8 | 1000 | 6 | yes | 17 | 120 | 6.5 | good | 2.5 | good |
| Ex. 17 | *6 | 5000 | *7 | 800 | *8 | 4000 | 6 | yes | 81 | 130 | 1.6 | good | 1.7 | good |
| Ref. Ex. 1 | *6 | 5000 | — | — | *8 | 500 | 6 | no | 17 | 160 | 9.4 | not good | 2.5 | good |
| Comp. Ex. 4 | — | — | — | — | *8 | 500 | 6 | no | 35 | 5 | 0.1 | not good | 1.6 | good |
| Comp. Ex. 3 | treated with chromic phosphate | | | | *8 | 500 | 6 | no | 20 (Cr) | — | — | not good | 0.7 | not good |

*1: Polycarboxylic acid,
*2: treating time (sec),
*3: Deposited amount of layer (mg/m$^2$),
*4: Org/inorg ratio,
*5: Strength of adhesion after working (N/15 mm),
*6: polyester,
*7: polyacrylic acid,
*8: zirconium ion ticulate component, a polycarboxylic acid (polyacrylic acid "Julimer 10 LHP" manufactured by Toa Gosei Co.) as an additive, and a zirconium compound (Hexafluorozirconate manufactured by Aldrich Co.) in such amounts that the polyester was 4000 ppm, the particulate component was 1000 ppm, the polyacrylic acid was 200 ppm and the zirconium ions were 500 ppm and, as required, adding nitric acid or ammonia thereto to adjust the pH to be 1.8, to thereby form a conversion-coated layer thereon.

The thus prepared surface-treated aluminum plate was heated in advance at 250° C., and on both surfaces of the aluminum plate was thermally press-adhered a polyethylene terephthalate film in which 15 mol % of the isophthalic acid has been copolymerized (film thickness of 16 μm) by using laminate rolls followed immediately by cooling with water to obtain an organic resin-coated surface-treated aluminum plate.

The paraffin wax was electrostatically applied onto both surfaces of the obtained organic resin-coated surface-treated aluminum plate which was then punched into a circle 156 mm in diameter, and from which a shallow-drawn cup was prepared. Next, the shallow-drawn cup was subjected to the redraw-ironing working, to the doming and, further, to the trimming for the edge at the opening thereof to thereby obtain a can body. The specifications of the can body were as follows:

Diameter of the can body: 66 mm

Height of the can body: 168 mm

Average plate thickness reduction ratio of the can side wall to the initial plate thickness; 60%

Example 19

A surface-treated aluminum plate, an organic resin-coated surface-treated aluminum plate and a can body were obtained in the same manner as in Example 18 but changing the amount of the main agent or polyester particles in the treating solution into 2300 ppm, the amount of the particulate component or the crosslinked PMMA particles A into 200 ppm, the amount of the zirconium ions into 700 ppm, and the treating time into 6 seconds.

Example 20

A surface-treated aluminum plate, an organic resin-coated surface-treated aluminum plate and a can body were obtained in the same manner as in Example 19 but changing the amount of the main agent or the polyester particles in the treating solution into 2000 ppm, and the amount of the particulate component or the crosslinked PMMA particles A into 500 ppm.

Example 21

A surface-treated aluminum plate, an organic resin-coated surface-treated aluminum plate and a can body were obtained in the same manner as in Example 19 but changing the amount of the main agent or the polyester particles in the treating solution into 1500 ppm, and the amount of the particulate component or the crosslinked PMMA particles A into 1000 ppm.

Example 22

A surface-treated aluminum plate, an organic resin-coated surface-treated aluminum plate and a can body were obtained in the same manner as in Example 19 but changing the amount of the main agent or polyester particles in the treating solution into 1000 ppm, and the amount of the particulate component or the crosslinked PMMA particles A into 1500 ppm.

Example 23

A surface-treated aluminum plate, an organic resin-coated surface-treated aluminum plate and a can body were obtained in the same manner as in Example 20 but changing the amount of the additive or the polyacrylic acid into 100 ppm.

Example 24

A surface-treated aluminum plate, an organic resin-coated surface-treated aluminum plate and a can body were obtained in the same manner as in Example 20 but changing the amount of the additive or the polyacrylic acid into 1000 ppm.

Example 25

A surface-treated aluminum plate, an organic resin-coated surface-treated aluminum plate and a can body were obtained in the same manner as in Example 24 but changing the amount of the zirconium ions into 4000 ppm.

Example 26

A surface-treated aluminum plate, an organic resin-coated surface-treated aluminum plate and a can body were obtained in the same manner as in Example 21 but changing the amount of the zirconium ions into 150 ppm.

Example 27

A surface-treated aluminum plate, an organic resin-coated surface-treated aluminum plate and a can body were obtained in the same manner as in Example 21 but changing the amount of the zirconium ions into 350 ppm.

Example 28

A surface-treated aluminum plate, an organic resin-coated surface-treated aluminum plate and a can body were obtained in the same manner as in Example 21 but changing the amount of the zirconium ions into 1400 ppm.

Example 29

A surface-treated aluminum plate, an organic resin-coated surface-treated aluminum plate and a can body were obtained in the same manner as in Example 21 but using, as the particulate component, crosslinked PMMA particles B (Epostar 030W, particle size of 40 nm, manufactured by Nippon Shokubai Co.) instead of the crosslinked PMMA particles A.

Example 30

A surface-treated aluminum plate, an organic resin-coated surface-treated aluminum plate and a can body were obtained in the same manner as in Example 21 but using, as the particulate component, crosslinked PMMA particles C (Epostar 100W, particle size of 155 nm, manufactured by Nippon Shokubai Co.) instead of the crosslinked PMMA particles A.

Example 31

A surface-treated aluminum plate, an organic resin-coated surface-treated aluminum plate and a can body were obtained in the same manner as in Example 18 but changing the amount of the main agent or the polyester particles into 5000 ppm, changing the particulate component or the crosslinked PMMA particles A into inorganic silica particles A (LUDOX TMA, particle size of 20 nm, manufactured by W.R. Grace & Company).

Example 32

A surface-treated aluminum plate, an organic resin-coated surface-treated aluminum plate and a can body were obtained in the same manner as in Example 31 but changing the particulate component or the inorganic silica particles A into inorganic silica particles B (LUDOX SM30, particle size of 7 nm, manufactured by W.R. Grace & Company).

Comparative Example 5

A surface-treated aluminum plate, an organic resin-coated surface-treated aluminum plate and a can body were obtained in the same manner as in Example 18 but using none of the water-dispersible polyester resin, particulate component or polycarboxylic acid, changing the amount of the zirconium ions into 1000 ppm.

Reference Example 2

A surface-treated aluminum plate, an organic resin-coated surface-treated aluminum plate and a can body were obtained in the same manner as in Comparative Example 5 but changing the amount of the water-dispersible polyester resin into 5000 ppm and the amount of the zirconium ions into 250 ppm.

Reference Example 3

A surface-treated aluminum plate, an organic resin-coated surface-treated aluminum plate and a can body were obtained in the same manner as in Comparative Example 5 but changing the amount of the main agent or the water-dispersible polyester resin into 2500 ppm and the amount of the polyacrylic acid into 200 ppm.

TABLE 3

| | Organic component | | Particulate component | | Polycarboxylic acid | | Inorganic component | | Treating |
|---|---|---|---|---|---|---|---|---|---|
| | Kind | Amount (ppm) | Kind | Amount (ppm) | Kind | Amount (ppm) | Kind | Amount (ppm) | time (sec) |
| Ex. 18 | *1 | 4000 | *2 | 1000 | *5 | 200 | *6 | 500 | 10 |
| Ex. 19 | *1 | 2300 | *2 | 200 | *5 | 200 | *6 | 700 | 6 |
| Ex. 20 | *1 | 2000 | *2 | 500 | *5 | 200 | *6 | 700 | 6 |
| Ex. 21 | *1 | 1500 | *2 | 1000 | *5 | 200 | *6 | 700 | 6 |
| Ex. 22 | *1 | 1000 | *2 | 1500 | *5 | 200 | *6 | 700 | 6 |
| Ex. 23 | *1 | 2000 | *2 | 500 | *5 | 200 | *6 | 700 | 6 |
| Ex. 24 | *1 | 2000 | *2 | 500 | *5 | 1000 | *6 | 700 | 6 |
| Ex. 25 | *1 | 2000 | *2 | 500 | *5 | 1000 | *6 | 4000 | 6 |
| Ex. 26 | *1 | 1500 | *2 | 1000 | *5 | 200 | *6 | 150 | 6 |
| Ex. 27 | *1 | 1500 | *2 | 1000 | *5 | 200 | *6 | 350 | 6 |
| Ex. 28 | *1 | 1500 | *2 | 1000 | *5 | 200 | *6 | 1400 | 6 |
| Ex. 29 | *1 | 1500 | *3 | 1000 | *5 | 200 | *6 | 700 | 6 |
| Ex. 30 | *1 | 1500 | *4 | 1000 | *5 | 200 | *6 | 700 | 6 |
| Ex. 31 | *1 | 5000 | *2 | 1000 | *5 | 200 | *6 | 500 | 10 |
| Ex. 32 | *1 | 5000 | *3 | 1000 | *5 | 200 | *6 | 500 | 10 |
| Comp. Ex. 3 | Treated with chromic phosphate | | | | | | | | |
| Comp. Ex. 5 | — | — | — | — | — | — | *6 | 1000 | 6 |
| Ref. Ex. 2 | *1 | 5000 | — | — | — | — | *6 | 250 | 6 |
| Ref. Ex. 3 | *1 | 2500 | — | — | *5 | 200 | *6 | 1000 | 6 |

| | Deposited amount of layer ($mg/m^2$) | | Org/inorg ratio | Particle Filling ratio | Metal chelate | Corrosion | Adhesion of film during |
|---|---|---|---|---|---|---|---|
| | M | C | (C/M) | (wt %) | complex | resistance | heating |
| Ex. 18 | 30 | 436 | 15 | 14 | yes | good | good |
| Ex. 19 | 14 | 208 | 15 | 8 | yes | good | good |
| Ex. 20 | 18 | 209 | 12 | 10 | yes | good | good |
| Ex. 21 | 25 | 198 | 8 | 20 | yes | good | good |
| Ex. 22 | 23 | 168 | 7 | 38 | yes | good | good |
| Ex. 23 | 22 | 293 | 13 | 10 | yes | good | good |
| Ex. 24 | 18 | 244 | 14 | 11 | yes | good | good |
| Ex. 25 | 45 | 214 | 5 | 10 | yes | good | good |
| Ex. 26 | 8 | 218 | 27 | 21 | yes | good | good |
| Ex. 27 | 14 | 195 | 14 | 20 | yes | good | good |
| Ex. 28 | 26 | 117 | 5 | 20 | yes | good | good |
| Ex. 29 | 28 | 243 | 9 | 3 | yes | good | good |
| Ex. 30 | 32 | 218 | 7 | 14 | yes | good | good |
| Ex. 31 | 28 | 405 | 14 | 8 | yes | good | good |
| Ex. 32 | 38 | 519 | 14 | 5 | yes | good | good |
| Comp. Ex. 3 | 20 (Cr) | | — | — | no | not good | good |

TABLE 3-continued

| | | | | | | | |
|---|---|---|---|---|---|---|---|
| Comp. Ex. 5 | 23 | 4 | 0 | — | no | not good | good |
| Ref. Ex. 2 | 17 | 422 | 25 | — | no | good | not good |
| Ref. Ex. 3 | 24 | 320 | 13 | — | yes | good | not good |

*1: water-dispersible polyester resin.
*2: crosslinked PMMA particles A,
*3: crosslinked PMMA particles B,
*4: crosslinked PMMA particles C
*5: polyacrylic acid,
*6: zirconium ions As will be obvious from Table 3, adhesiveness of the film is not satisfactory during the heat treatment even when there is formed the conversion-coated layer that is blended with the water-dispersible polyester resin or with the water-dispersible polyester resin and with the polycarboxylic acid (Reference Examples 2 and 3). When the particulate component is contained, on the other hand, excellent results are obtained in both the corrosion resistance and the close adhesion of the film during the heat treatment. From the above-mentioned reasons, the surface-treated aluminum plate of the invention that is blended with the particulate component, is practically very useful for producing can bodies and can lids that must endure severe working and must protect the metal plate therein, effectively preventing the organic resin coating from peeling during the heat treatment after the draw-ironing working, in the step of heat treatment in which severe working is conducted and at the flange-forming portion.

Industrial Applicability

The surface-treated aluminum plate of the present invention has excellent corrosion resistance and adhesiveness to the organic resin coating. The organic resin-coated surface-treated aluminum plate obtained by coating the surface-treated aluminum plate with an organic resin exhibits very good close adhesion during the working even when it is subjected to a severe working, effectively preventing the organic resin coating from peeling during the heat treatment and, therefore, lending itself well suited for being used for producing can bodies that are formed through severe working such as of producing draw-ironed cans and for producing can lids such as easy-open lids that are to be subjected to the riveting or scoring working.

Owing to its excellent corrosion resistance, further, the surface-treated aluminum plate of the invention can be favorably used as a material for producing can bodies and can lids for containing strongly corrosive contents.

BRIEF DESCRIPTION OF REFERENCE NUMERALS

1: organic resin-coated surface-treated aluminum plate
2: aluminum alloy material
3: conversion-coated layer
4: organic resin coating material
5: particulate component

What is claimed is:

1. A surface-treating solution for treating the surface of an aluminum plate by a conversion treatment, the surface-treating solution containing a water-dispersible polyester resin,
fluorine ions, and
zirconium ions or titanium ions;
wherein said water-dispersible polyester resin is contained in an amount of 100 to 10,000 ppm, and said zirconium ions or said titanium ions are contained in an amount of 5 to 5,000 ppm.

2. The surface-treating solution according to claim 1, wherein a polycarboxylic acid and/or a water-dispersible particulate component is contained.

3. The surface-treating solution according to claim 2, wherein said polyester resin is contained in an amount of 500 to 10,000 ppm,
said water-dispersible particulate component is contained in an amount of 100 to 3,000 ppm,
said polycarboxylic acid is contained in an amount of 5 to 2,000 ppm, and
said zirconium ions or said titanium ions are contained in an amount of 5 to 5,000 ppm.

* * * * *